US009624067B1

(12) United States Patent
Tomney et al.

(10) Patent No.: US 9,624,067 B1
(45) Date of Patent: Apr. 18, 2017

(54) GUIDE MEMBER FOR GUIDING LONGITUDINAL FLEXIBLE MEMBERS AROUND A WHEEL

(71) Applicants: Justin Tomney, West Islip, NY (US); Michael R. Bizzaro, Bohemia, NY (US)

(72) Inventors: Justin Tomney, West Islip, NY (US); Michael R. Bizzaro, Bohemia, NY (US)

( * ) Notice: Subject to any disclaimer, the term of this patent is extended or adjusted under 35 U.S.C. 154(b) by 19 days.

(21) Appl. No.: 14/870,224

(22) Filed: Sep. 30, 2015

(51) Int. Cl.
*B65H 57/00* (2006.01)
*B65H 57/02* (2006.01)

(52) U.S. Cl.
CPC ..... *B65H 57/02* (2013.01); *B65H 2701/33* (2013.01)

(58) Field of Classification Search
CPC .... B65H 57/02; B65H 2701/33; B65H 23/00; B65H 23/038; B65H 23/04
See application file for complete search history.

(56) References Cited

U.S. PATENT DOCUMENTS 1,914,743 A * 6/1933 Hughes ..... B60P 3/077 188/32
2,603,432 A * 7/1952 Paulsen ..... B05B 15/00 24/DIG. 48
2,814,460 A * 11/1957 Marcolongo ..... B05B 15/00 242/157 R
3,097,827 A * 7/1963 McDaniel ..... B60S 5/00 242/615.2
4,404,925 A * 9/1983 Louwsma ..... B05B 15/00 118/506
4,778,135 A * 10/1988 Legard ..... B60T 3/00 188/32
4,836,432 A 6/1989 Violette
4,884,664 A * 12/1989 Berg ..... B60T 3/00 188/32
4,895,225 A 1/1990 Parnell
5,427,339 A 6/1995 Pauli et al.
5,549,262 A 8/1996 Whitehead
5,853,142 A * 12/1998 Anderson ..... B65H 57/14 137/355.16
D432,902 S 10/2000 Thiel
6,598,826 B1 7/2003 Therriault
6,622,960 B2 9/2003 Hyde
D492,928 S * 7/2004 Pond ..... D12/217
D639,147 S 6/2011 Surles
D769,105 S * 10/2016 Tomney ..... D12/217
2013/0193262 A1 8/2013 Torres et al.

* cited by examiner

*Primary Examiner* — William A Rivera
(74) *Attorney, Agent, or Firm* — Carter, DeLuca, Farrell & Schmidt, LLP

(57) ABSTRACT

A guide member for use in connection with a wheel of a vehicle includes a wall and a base. The wall extends from a lower surface to an upper surface. The lower surface defines a support plane. The wall has an inner surface and an outer surface. The base extends from the lower surface of the wall. The base has a top surface and a bottom surface. The base is disposed transverse to the wall at a non-perpendicular angle to define a space between the bottom surface of the base and the support plane. The inner surface of the wall and the top surface of the base define a receiving pocket configured to receive a wheel of the vehicle therein, whereby the outer surface of the wall guides a longitudinal flexible member around the wheel of the vehicle.

17 Claims, 5 Drawing Sheets

GUIDE MEMBER FOR GUIDING LONGITUDINAL FLEXIBLE MEMBERS AROUND A WHEEL

TECHNICAL FIELD

The present disclosure relates to vehicle accessories, and more specifically, to devices and/or methods for guiding longitudinal flexible members such as hoses, cords and/or cables around wheels or tires of vehicles.

BACKGROUND

While vehicles are designed to last for many years, maintenance and repair are common undertakings associated with vehicle use. Such maintenance and/or repair may involve washing, painting, removal/replacement of various parts, etc. In performing these undertakings, it is often necessary to utilize tools having hoses, cords, and/or cables that are susceptible to being caught, snagged, or tangled when drawing the various hoses, cords, or cables around the vehicle to access other remote locations. For example, while washing a car, garden hoses are often drawn around the car to rinse dirt or soap off of the trim of the vehicle. As the hose is drawn about the vehicle, the hose can become trapped underneath a tire thereof, inhibiting additional movement about the vehicle until the hose is freed, wasting time and effort.

Accordingly, a need exists to provide a steadfast device that prevents longitudinal flexible members such as hoses, cords, and cables from becoming trapped as they are drawn around a vehicle while simultaneously guiding them about the vehicle.

SUMMARY

The present disclosure is directed to a guide member for use in connection with a wheel of a vehicle. The guide member includes a wall extending from a lower surface to an upper surface. The lower surface defines a support plane. The wall has an inner surface and an outer surface. The base extends from the lower surface of the wall. The base has a top surface and a bottom surface. The base is disposed transverse to the wall at a non-perpendicular angle to define a space between the bottom surface of the base and the support plane defined by the lower surface of the wall. The inner surface of the wall and the top surface of the base define a receiving pocket configured to receive a wheel of the vehicle therein, whereby the outer surface of the wall guides a longitudinal flexible member around the wheel of the vehicle.

In some embodiments, the wall and the base may be integrally formed.

In certain embodiments, the outer surface of the wall is smooth and brimless.

In some embodiments, the wall defines a thickness that tapers from the lower surface toward the upper surface thereof. The upper surface of the wall may be flat. The upper surface of the wall, the inner surface of the wall, and the top surface of the base may be configured to contact a wheel of the vehicle when such wheel is fully seated in the receiving pocket.

In certain embodiments, the base tapers away from the wall to a blunt tip. The blunt tip may be centrally disposed along a centerline of the guide member. The blunt tip may be rounded.

In some embodiments, the base, the wall, or both the base and the wall may include surface texturing. The top surface of the base portion may include surface texturing configured to increase friction with a wheel of the vehicle when such wheel of the vehicle is received in the receiving pocket. The surface texturing may include one or more embossed characters.

In certain embodiments, the wall may be arcuate and extend radially around the base.

In some embodiments, the inner surface of the wall may be perpendicular to the support plane and the outer surface of the wall may be disposed at a non-perpendicular angle relative to the support plane.

In certain embodiments, the receiving pocket may be configured to receive therein a wheel of the vehicle sized between about 14 inches in diameter to about 24 inches in diameter.

In some embodiments, the wall, the base, or both the wall and the base define a hanging feature.

In certain embodiments, the base defines a substantially triangular shaped profile.

According to one aspect, the present disclosure is directed to a guide member including a wall and a base. The wall has an inner surface and an outer surface. The base extends from the inner surface of the wall. The base has a top surface and a bottom surface. The inner surface of the wall and the top surface of the base are disposed at a non-perpendicular angle relative to one another to define an angled receiving pocket. The receiving pocket is configured to receive a wheel of a vehicle therein. The outer surface of the wall is positioned to guide a longitudinal flexible member around such wheel when such wheel is received in the receiving pocket.

In certain embodiments, the guide member further includes surface texturing on one or both of the wall or the base.

In some embodiments, the base tapers from the inner surface of the wall to a blunt tip.

Other aspects, features, and advantages will be apparent from the description, the drawings, and the claims that follow.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description given below, serve to explain the principles of the disclosure, wherein.

DETAILED DESCRIPTION

Figure 1:
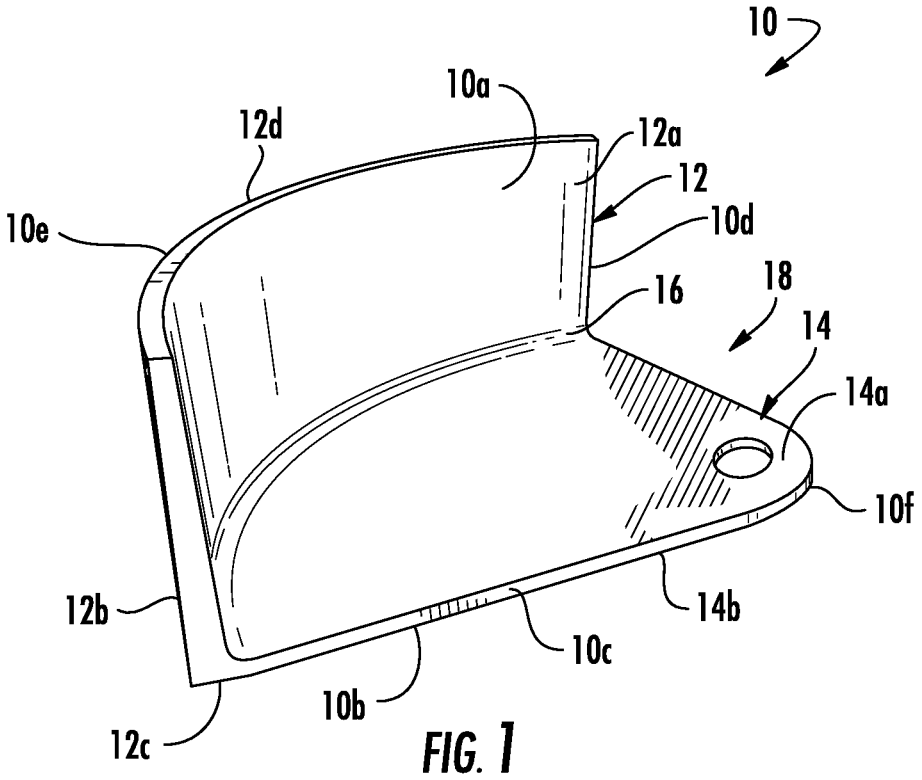
FIG. 1 is a perspective view of one embodiment of a guide member in accordance with the principles of the present disclosure.
Figure 2:
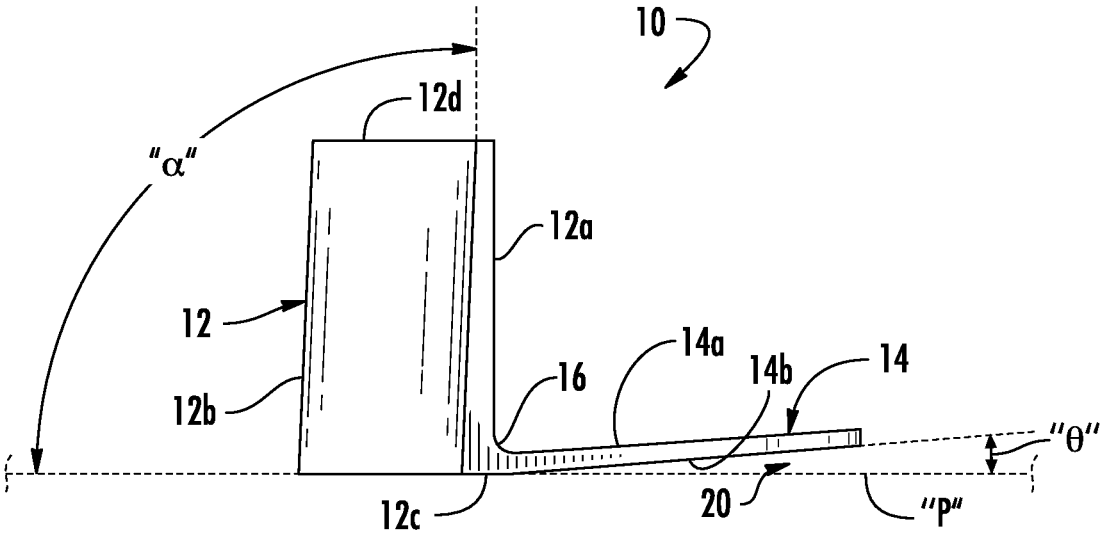
FIG. 2 is a right, side view of the guide member of FIG. 1 and a support plane defined by the guide member.
Figure 3:
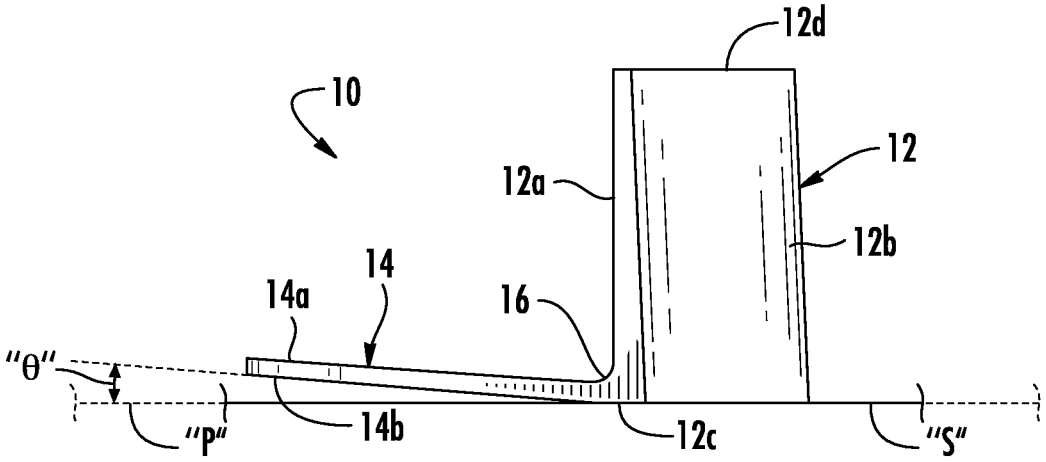
FIG. 3 is a left, side view of the guide member of FIG. 1 and the support plane of FIG. 2 shown supported on a surface.

Embodiments of the presently disclosed devices are described in detail with reference to the drawings, in which like reference numerals designate identical or corresponding elements in each of the several views. As used herein, the term "distal" or "leading" refers to that portion of the device that is farther from the user, while the term "proximal" or "trailing" refers to that portion of the device that is closer to the user.

Turning now to FIGS. 1-8, a guide member, generally referred to as guide member 10 is provided. The guide member 10 may be used in connection with a wheel "W" (e.g., a tire) of a vehicle "V" (e.g., a car, a truck, or motorcycle) to enable one or more flexible longitudinal members "H" (e.g., hoses, a cables, and/or cords) to be drawn therealong for accessing remote locations while preventing the flexible longitudinal members "H" from being trapped beneath the wheel "W," or wedged between the wheel "W" and the ground or support surface "S."

The guide member 10 includes a wall 12 and a base 14 secured to the wall 12. The guide member 10 has a top surface 10*a*, a bottom surface 10*b*, a first side surface 10*c*, and a second side surface 10*d*. The first and second side surfaces 10*c*, 10*d* extend distally from a proximal end 10*e* of the guide member 10 toward one another (e.g., taper inwardly) and connect at a distal end or a distal tip 10*f* of the guide member 10. The distal tip 10*f* may be blunt and/or rounded to reduce the risk of damaging the wheel "W" when the guide member 10 is secured to the wheel "W" as described in greater detail below. The first and second side surfaces 10*c*, 10*d* may each be substantially L-shaped and disposed in mirrored relation to one another on opposite sides of the guide member 10.

Figure 4:
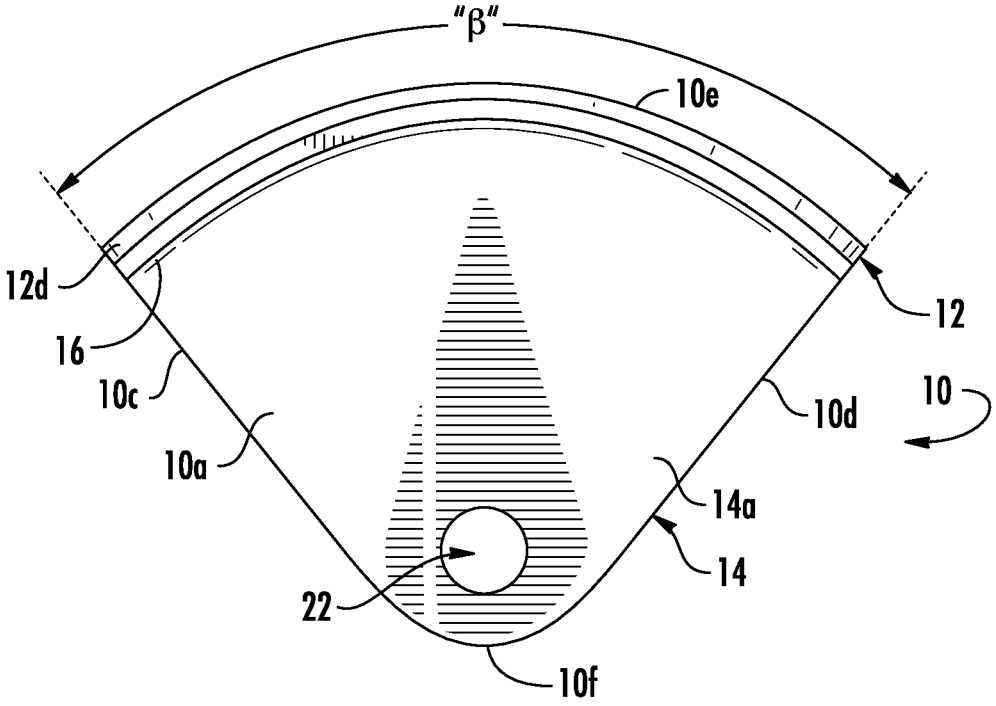
FIG. 4 is a top view of the guide member of FIG. 1.

The wall 12 of the guide member 10 extends radially around (e.g., along an arcuate or radial trajectory) a proximal end of the base 14 between a radial angle "β" of the guide member 10. The radial angle "β" of the guide member 10 is defined between the first and second side surfaces 10*c*, 10*d* of the guide member 10 as seen in FIG. 4. The wall 12 has an inner surface 12*a*, an outer surface 12*b*, a lower surface 12*c*, and an upper surface 12*d*. The lower surface 12*c* of the wall 12 defines a support plane "P" (FIG. 2) that is perpendicular to the inner surface 12*a* of the wall 12. The lower surface 12*c* may be flat or planar and is configured to support the guide member 10 on a support surface "S" (FIG. 3) such as ground or pavement. The outer surface 12*b* of the wall 12 is disposed at a non-perpendicular angle "a" relative to the support plane "P" (e.g., transverse to the support plane "P") such that a thickness of the wall 12 tapers upwardly from the lower surface 12*c* to the upper surface 12*d* so that the upper surface 12*d* is tilted slightly forward or distally. The outer surface 12*b* of the wall 12 is smooth and brimless to enable the flexible longitudinal members "H" to smoothly and quickly advance therealong with limited encumbrance and/or friction. The upper surface 12*d* may be planar or flat. With the upper surface 12*d* tilted slightly forward because of the angled disposition of the outer surface 12*b* of the wall 12, the entire upper surface 12*d* and/or portions thereof (e.g., edges thereof) are configured to contact the wheel "W" to increase frictional securement of the guide member 10 to the wheel "W" when the wheel "W" is received by the guide member 10.

The wall 12 connects to a base 14 at a connecting corner 16. The wall 12, base 14 and/or the connecting corner 16 may be integrally and/or monolithically formed. The base 14 extends distally from the wall 12 to the distal tip 10*f* of the guide member 10. In embodiments, the base 14 may define a substantially triangular shaped profile. The distal tip 10*f* may be centrally disposed along a centerline "CL" (FIG. 5) of the guide member 10. The base 14 includes a top surface 14*a* and a bottom surface 14*b*. The base 14 is disposed at a non-perpendicular angle "Θ" relative to the support plane "P" such that the base 14 is transverse to the wall 12 and defines a space 20 between the bottom surface 14*b* of the base 14 and the support plane "P." The inner surface 12*a* of the wall 12 and the top surface 14*a* of the base 14 define an angled receiving pocket 18. The receiving pocket 18 is configured to receive and removably secure to any suitable wheel. The receiving pocket 18 of the guide member 10 is configured to fully seat wheels such as 14-inch diameter automobile tires (e.g., a sedan) up to 24-inch diameter truck tires (e.g., a fire truck). The angled disposition of the base 14 and receiving pocket 18 enables the receiving pocket 18 to more securely receive the wheel "W" of the vehicle "V" by providing increased friction with the wheel "W" when the wheel "W" is received in the receiving pocket 18.

In use, the guide member 10 is positioned adjacent to a wheel "W" so that the guide member 10 and the wheel "W" can be approximated. Approximation of the wheel "W" and the guide member 10 enables the wheel "W" to be received within the receiving pocket 18. With the wheel "W" fully seated within the receiving pocket 18 of the guide member 10, the base 14 of the guide member 10 extends beneath the wheel "W" and the wall 12 of the guide member 10 abuts the wheel "W."

Figure 8:
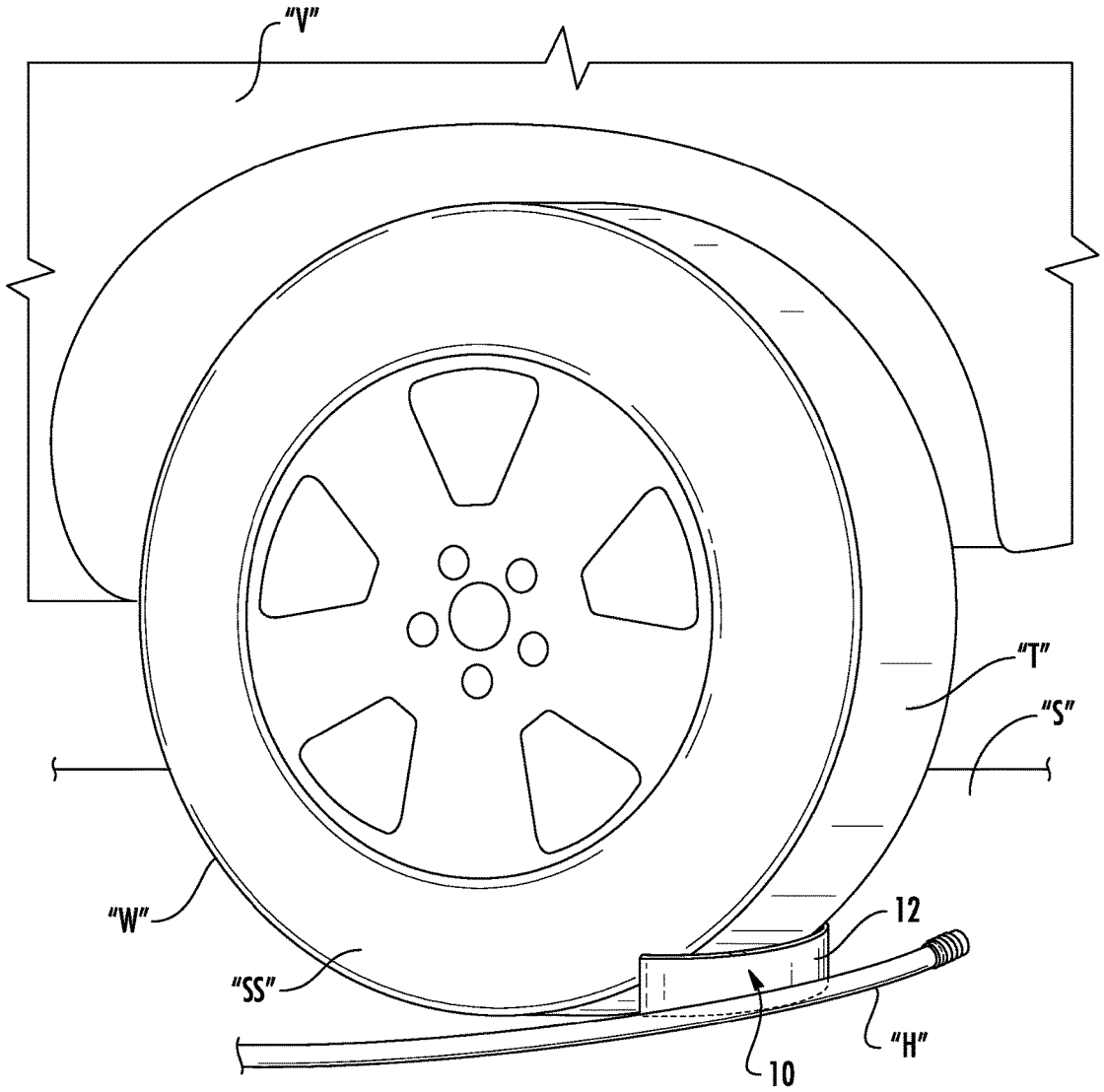
FIG. 8 is a perspective view of the guide member of FIG. 1 illustrating a wheel of a vehicle received by the guide member and a hose advanced along the guide member.

As seen in FIG. 8, the guide member 10 can be oriented so that the wall 12 extends across the thickness "T" of the wheel "W" (e.g., against tread of a tire). Alternatively, the guide member 10 can be oriented along an outer side surface "SS" of the wheel "W" so that the wall 12 of the guide member 10 extends along the outer side surface "SS" of the wheel "W." Regardless of the orientation of the guide member 10, the outer surface 12 of the wall 12 of the guide member 10 is positioned to guide one or more flexible longitudinal members "H" (e.g., a hose, a cable, and/or a cord) around the wheel "W" and/or the wheeled vehicle "V" as the flexible longitudinal member "H" is drawn therealong to prevent the flexible longitudinal member "H" from being trapped beneath the wheel "W."

In some embodiments, the guide member 10, or portions thereof, may include surface texturing to facilitate wheel gripping/securement of the guide member 10 to the wheel "W" and/or to increase frictional engagement with the support surface "S" to limit movement of the guide member 10 when force (e.g., from a hose or the like) is imparted thereon. For example, the surface texturing may include one or more embossed characters (e.g., letters), grooves, knurling, or the like extending from one or more surfaces of the guide member 10.

Figure 5:
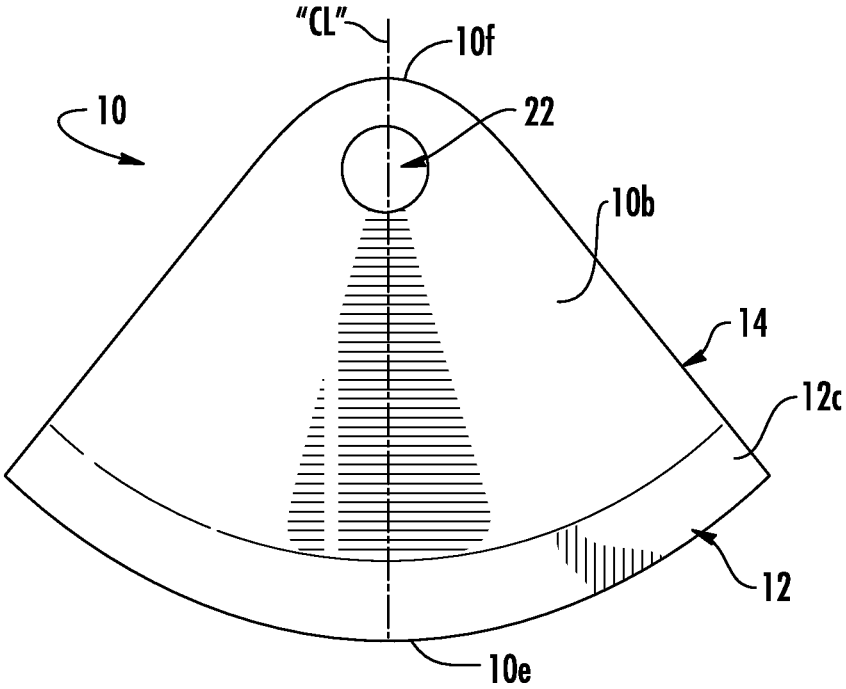
FIG. 5 is a bottom view of the guide member of FIG. 1.
Figure 6:
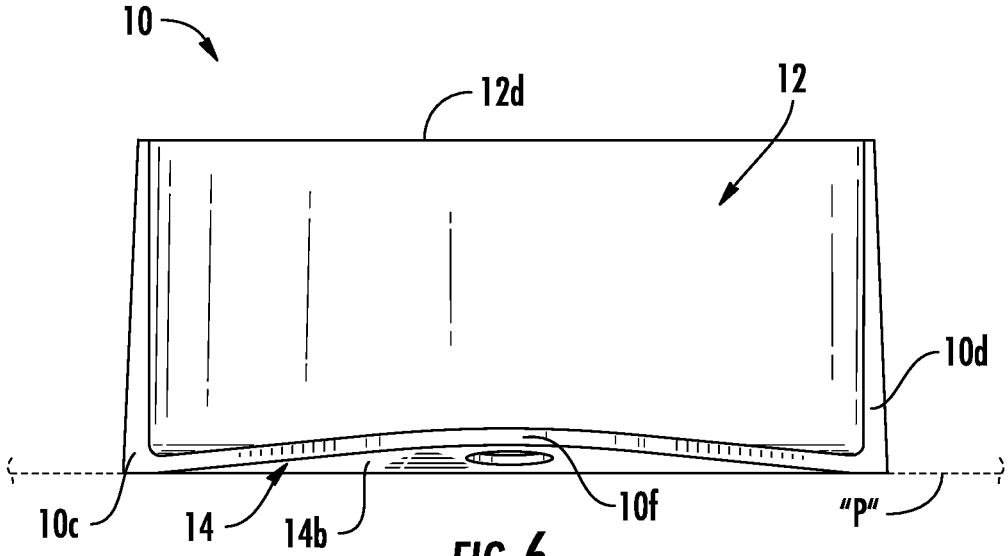
FIG. 6 is a front view of the guide member of FIG. 1.
Figure 7:
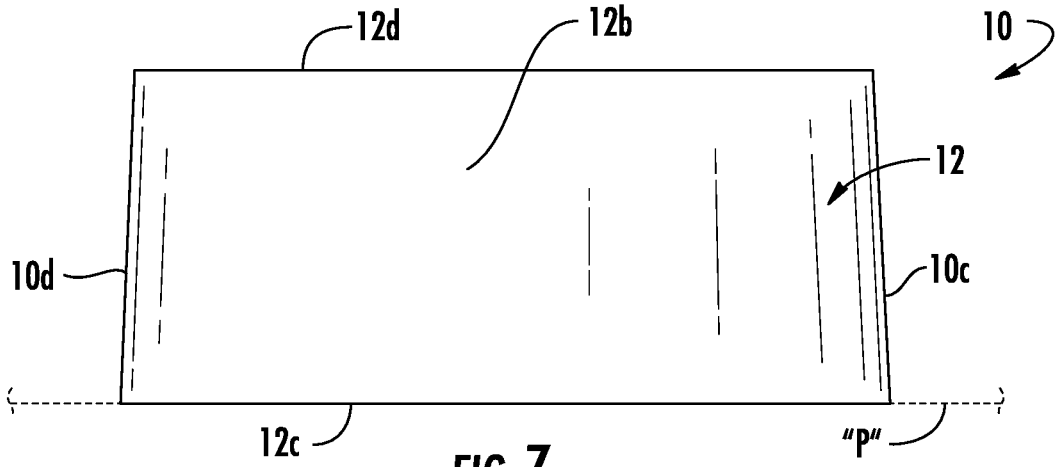
FIG. 7 is a back view of the guide member of FIG. 1.

In certain embodiments, the guide member 10, or portions thereof, may include a hanging feature such a hole, hook, or the like defined therein and/or extending therefrom that enables ready storage of the guide member 10. For example, as seen in FIGS. 4 and 5, the base 14 may define a hole 22 therethrough adjacent the distal tip 10*f* to enable the guide member 10 to be mounted on a wall mounted hook (not shown).

Any of the presently disclosed embodiments of the guide member, or one or more components thereof, may be formed of any suitable metallic, polymeric, and/or ceramic material. In embodiments, the guide member, or one or more components thereof, may be formed using any suitable formation and/or securing technique including injection molding, welding, adhering, fastening, etc.

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the present disclosure, and that such modifications and variations are also included within the scope of the present disclosure. Accordingly, the subject matter of the present disclosure is not limited by what has been particularly shown and described.

The invention claimed is:

1. A guide member for use in connection with a wheel of a vehicle, the guide member comprising:

a wall extending from a lower surface to an upper surface, the lower surface defining a support plane, the wall having an inner surface and an outer surface; and a base extending from the lower surface of the wall, the base having a top surface and a bottom surface, the base disposed transverse to the wall at a non-perpendicular angle to define a space between the bottom surface of the base and the support plane defined by the lower surface of the wall, the inner surface of the wall and the top surface of the base defining a receiving pocket configured to receive a wheel of the vehicle therein, whereby the outer surface of the wall guides a longitudinal flexible member around the wheel of the vehicle.

2. The guide member of claim 1, wherein the wall and the base are integrally formed.

3. The guide member of claim 1, wherein the outer surface of the wall is smooth and brimless.

4. The guide member of claim 1, wherein the wall defines a thickness that tapers from the lower surface toward the upper surface thereof.

5. The guide member of claim 4, wherein the upper surface of the wall is flat.

6. The guide member of claim 5, wherein the upper surface of the wall, the inner surface of the wall, and the top surface of the base are configured to contact a wheel of the vehicle when such wheel is fully seated in the receiving pocket.

7. The guide member of claim 1, wherein the base tapers away from the wall to a blunt tip.

8. The guide member of claim 7, wherein the blunt tip is centrally disposed along a centerline of the guide member.

9. The guide member of claim 7, wherein the blunt tip is rounded.

10. The guide member of claim 1, wherein the base, the wall, or both the base and the wall include surface texturing.

11. The guide member of claim 10, wherein the top surface of the base portion includes surface texturing configured to increase friction with a wheel of the vehicle when such wheel of the vehicle is received in the receiving pocket.

12. The guide member of claim 11, wherein the surface texturing includes at least one embossed character.

13. The guide member of claim 1, wherein the wall is arcuate and extends radially around the base.

14. The guide member of claim 1, wherein the inner surface of the wall is perpendicular to the support plane and the outer surface of the wall is disposed at a non-perpendicular angle relative to the support plane.

15. The guide member of claim 1, wherein the receiving pocket is configured to receive therein a wheel of the vehicle sized between about 14 inches in diameter to about 24 inches in diameter.

16. The guide member of claim 1, wherein the wall, the base, or both the wall and the base define a hanging feature.

17. The guide member of claim 1, wherein the base defines a substantially triangular shaped profile.

* * * * *